US008729004B2

(12) United States Patent
Lasik et al.

(10) Patent No.: US 8,729,004 B2
(45) Date of Patent: May 20, 2014

(54) COMPOSITIONS AND METHODS OF MAKING AND USING THE SAME

(71) Applicant: West End Products, LLC, Alpharetta, GA (US)

(72) Inventors: Dennis Z. Lasik, Cumming, GA (US); William F. Mullen, Cumming, GA (US)

(73) Assignee: West End Products, LLC, Alpharetta, GA (US)

( * ) Notice: Subject to any disclaimer, the term of this patent is extended or adjusted under 35 U.S.C. 154(b) by 0 days.

(21) Appl. No.: 13/971,874

(22) Filed: Aug. 21, 2013

(65) Prior Publication Data

US 2014/0057820 A1 Feb. 27, 2014

Related U.S. Application Data

(60) Provisional application No. 61/691,584, filed on Aug. 21, 2012.

(51) Int. Cl.

| | |
|---|---|
| ***C11D 1/12*** | (2006.01) |
| ***C11D 1/22*** | (2006.01) |
| ***C11D 3/43*** | (2006.01) |
| ***B08B 3/04*** | (2006.01) |

(52) U.S. Cl.

USPC ..... 510/211; 510/342; 510/351; 510/426; 510/432; 134/25.2; 134/25.3; 134/39; 134/42; 8/137

(58) Field of Classification Search

CPC ..... B08B 3/04; C11D 1/12; C11D 1/22; C11D 3/2034; C11D 3/2093; C11D 3/43

USPC ..... 510/211, 342, 351, 426, 432; 134/25.2, 134/25.3, 39, 42; 8/137

See application file for complete search history.

(56) References Cited

U.S. PATENT DOCUMENTS

| | | | | |
|---|---|---|---|---|
| 7,871,970 | B2 | 1/2011 | Zanetto et al. | |
| 2002/0016274 | A1 | 2/2002 | Pearl | |
| 2006/0058208 | A1 | 3/2006 | Ventura et al. | |
| 2007/0093404 | A1 * | 4/2007 | Gross et al. ..... | 510/407 |

* cited by examiner

*Primary Examiner* — Brian P Mruk

(74) *Attorney, Agent, or Firm* — Withers & Keys, LLC

(57) ABSTRACT

Chemical compositions and method of making the same are disclosed. The disclosed chemical compositions are particularly useful in methods of removing unwanted components within a papermaking process.

22 Claims, No Drawings

COMPOSITIONS AND METHODS OF MAKING AND USING THE SAME

CROSS-REFERENCE TO RELATED APPLICATIONS

This patent application claims the benefit of priority to U.S. Provisional Patent Application Ser. No. 61/691,584 filed on Aug. 21, 2012 and entitled "COMPOSITIONS AND METHODS OF MAKING AND USING THE SAME", the subject matter of which is hereby incorporated by reference in its entirety.

FIELD OF THE INVENTION

The present invention is directed to chemical compositions and methods for "deep cleaning" paper mill clothing surfaces so as to restore clothing permeability. The present invention is further directed to methods for simultaneously removing fiber, fines, organics and stickies (i.e., particles retained by 0.10 through 0.15 mm slotted screens) from machine surfaces, clothing, and suction rolls.

BACKGROUND

Optimum machine clothing (i.e., forming wire, press fabric and dryer fabrics) run-ability depends on maintaining "like-new" permeability for an extended period of time. This can best be accomplished with an effective "deep cleaning"/conditioning program. During pressing, water that contains solids, fines, and other contaminants is removed from the bulk sheet and transferred to the machine clothing. Solids that accumulate in and on the machine clothing restrict removal of water from the bulk sheet. Over 10% accumulation is considered a heavily contaminated press fabric.

Cleaning/conditioning a forming wire typically utilizes a well directed shower in conjunction with caustic or caustic/aromatic hydrocarbon mix washing. The stubborn adherence of "macrostickies" (i.e., particles retained on a 0.15 mm slotted screen) on the forming wire surface leads to later problems such as wet end breaks, press section breaks, dryer section breaks, holes, sheet defects and high dirt counts. The end result of not removing macrostickies from the wire is unwanted downtime.

At present, the optimum press fabric cleaning/conditioning system utilizes both mechanical and chemical means to restore permeability. The mechanical means makes use of relatively high pressure showers and suction boxes. The shower water is usually, but not always, filtered to prevent particles larger than 100 microns from abrading the felt and the wash is usually carried out prior to contact with sheet side felt carrying rolls. Another sometimes neglected mechanical cleaning feature is the use of an oscillating needle water jet at controlled pressures. Proper oscillation of a high pressure cleaning shower is needed to assure uniform felt coverage—improper shower oscillation results in some areas of the felt remaining filled and some being cleaned (i.e., evident by streaky appearance).

At present, the optimum dryer fabric cleaning/conditioning system utilizes both mechanical and chemical means to restore permeability. The mechanical means makes use of relatively high pressure showers and scraping tools.

At present, the optimum surface and suction roll cleaning systems utilize both mechanical and chemical means to remove contaminates. These contaminants clog suction holes and interfere with the vacuum rolls ability to direct the bulk sheet in its turns through the machinery, causing breaks and downtime. Surfaces throughout the mill and the machinery become coated with these same contaminants, causing unsafe and unsightly conditions.

The chemical cleaners presently in use are either highly caustic (i.e., pH≥12) or caustic/aromatic hydrocarbon blends. Both are corrosive, and have physicals inappropriate for safe use (e.g., low flash points, components which are suspected carcinogens, etc.). The chemical systems are expected to remove hydrophobic contaminants such as adhesives, wax, wet strength resin, pitch and hydrocarbon oil, as well as inorganic precipitates such as clay, calcium carbonate, alum and titanium dioxide.

Efforts continue to provide efficient and environmentally sound chemical compositions that effectively clean substrates such as a paper machine clothing, surfaces, and suction rolls, as well as methods of removing microstickies and macrostickies from paper machine clothing, surfaces, and suction rolls.

SUMMARY OF THE INVENTION

The present invention relates to safe-to-use in the workplace, environmentally-friendly, compositions for use in removing organics, as well as inorganic residues, from contaminated paper machine wires, press felts, dryer fabrics, suction rolls and doctor blade holders in the wet press and dryer sections in the pulp and paper industry, as well as additional applications for cleaning similar fabrics/materials in other industries.

The present invention relates to the discovery of new chemical systems for "deep cleaning" paper machine clothing (i.e., a forming wire (e.g., a woven plastic fabric mesh conveyor belt), dewatering/press fabrics (e.g., a woven or nonwoven plastic/fabric belt) and dryer fabrics (e.g. woven or nonwoven plastic fabric belts)) used in the forming, pressing and drying stages of paper production. The new chemical systems of the present invention, unlike those currently in use (i.e., prior to the present invention), feature (i) improved cost-performance with low vapor pressure, volatile organic compound (LVP-VOC) compliance, (ii) biodegradability, (iii) California Prop. 65 compliance, (iv) safer handling, and (v) a non-flammable rating. The new chemical systems offer instantaneous restoration of water drainage on machine fabrics and long term conditioning needed to maintain permeability on same. The new chemical systems ensure continuous retention of drainage capability by conditioning the surface of the forming wire, press fabric, and dryer fabric to repel stickies and other contaminants. The new chemical systems clean surfaces and machinery.

The present invention is directed to (1) chemical compositions that are particularly effective in restoring permeability (e.g., for water drainage) on machine fabrics used in a wide variety industries, but in particular the paper industry, (2) chemical compositions that are particularly useful in maintaining the drainage capabilities of fabrics used in paper production and in a wide variety of industries, but in particular the paper industry, and (3) chemical compositions that clean surfaces of mills and machinery including, but not limited to, ductwork, walkways, railings, doctor blades and suctions rolls.

In one exemplary embodiment, the composition of the present invention comprises a blend of dibasic esters, aromatic alcohols, emulsifying surfactants, and an alkylbenzenesulfonic acid salt in colloidal or emulsified form. Concentrates can be diluted with water.

In another exemplary embodiment, the compositions of the present invention comprise at least one dibasic ester, and a micro-emulsion containing aromatic alcohols and co-solvents based on esterification of oleic acid, and are utilized with or without dibasic ester emulsifying surfactants and high molecular weight aromatic alcohols to achieve a variety of objectives including, but not limited to, the removal of wax, coating binders, coating fillers, starch, gums, retention aids, wet strength additives, adhesives and dyes from a variety of synthetic, as well as metal surfaces.

In yet another exemplary embodiment, the compositions of the present invention comprises a blend of alkyl and alkylcarboxylic acid fatty esters, aromatic alcohols, alkylbenzenesulfonic acid salt in colloidal or emulsified form. Concentrates can be diluted with water.

The compositions of the present invention comprising one or more of: (i) one or more dibasic esters, (ii) aromatic alcohols, (iii) esters of oleic acid, and (iv) emulsifying surfactants, provide desired characteristics in their low toxicity, non-corrosion and non-flammability relative to aromatic hydrocarbons and caustic-based paper machine clothing cleaners. Moreover, the compositions of the present invention are low vapor pressure VOC compliant and do not have harmful effect on the earth's stratospheric ozone layer. In addition, compositions of the present invention provide cleaning ability superior to those known in the art while also providing advantageous characteristics which are not found in most prior art compositions.

DETAILED DESCRIPTION

A description of exemplary compositions and composition components of the present invention is provided below.

I. Compositions

The compositions of the present invention may comprise (or consist essentially of, or consist of) a number of individual components. A description of individual components and combinations of individual components is provided below. Further, the compositions of the present invention may be presented in various forms. A description of types of compositions is also provided below.

A. Composition Components

The compositions of the present invention may comprise (or consist essentially of, or consist of) one or more of the following composition components.

1. Aliphatic Dibasic Esters

The compositions of the present invention may comprise one or more aliphatic dibasic esters, wherein each aliphatic dibasic ester has a structure:

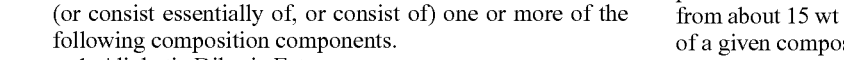

$$R_3—O—(CO)—(CR_1R_2)_m(CH_2)_n—(CO)—O—R_4 \quad (I)$$

wherein $R_1$ and $R_2$ are each independently (i) hydrogen or (ii) a straight chain or branched alkyl groups, and at least one of $R_1$ and $R_2$ comprises a straight chain or branched alkyl groups; $R_3$ and $R_4$ are each independently straight chain or branched alkyl groups; m is 0 or 1; and n is an integer greater than 1. Typically, when $R_1$ or $R_2$ is straight chain or branched alkyl groups, $R_1$ or $R_2$ comprises an alkyl group containing less than about 4 carbon atoms. In some exemplary embodiments, when $R_1$ or $R_2$ is straight chain or branched alkyl groups, $R_1$ or $R_2$ comprises a methyl group.

Typically, $R_3$ and $R_4$ are each independently straight chain or branched alkyl groups containing less than about 8 carbon atoms, more typically, less than about 4 carbon atoms. In some exemplary embodiments, $R_3$ and $R_4$ are each independently branched alkyl groups containing less than about 8 carbon atoms, more typically, less than about 4 carbon atoms. For example, in some exemplary embodiments, $R_3$ and $R_4$ are each independently a methyl group or an isobutyl group.

Although n is an integer greater than 1, n typically ranges from about 1 to about 4, more typically, either 2, 3 or 4. Typically, when m is 1, n ranges from about 1 to about 3, and when m is 0, n ranges from 2 to 4.

Exemplary aliphatic dibasic esters suitable for use in the present invention include, but are not limited to, an aliphatic dibasic ester having structure (I) above, wherein $R_1$ $R_3$ and $R_4$ are each methyl groups, $R_2$ is a hydrogen group, m is 1, and n is 2, namely, dimethyl-2-methyl glutarate; an aliphatic dibasic ester having structure (I) above, wherein $R_3$ and $R_4$ are each methyl groups, m is 0, and n is 4, namely, dimethyl adipate; an aliphatic dibasic ester wherein $R_3$ and $R_4$ are each methyl groups, m is 0, and n is 3, namely, dimethyl glutarate; an aliphatic dibasic ester wherein $R_3$ and $R_4$ are each methyl groups, m is 0, and n is 2, namely, dimethyl succinate; an aliphatic dibasic ester having structure (I) above, wherein $R_3$ and $R_4$ are each isobutyl groups, m is 0, and n is 4, namely, di-isobutyl adipate; an aliphatic dibasic ester wherein $R_3$ and $R_4$ are each isobutyl groups, m is 0, and n is 3, namely, di-isobutyl glutarate; and an aliphatic dibasic ester wherein $R_3$ and $R_4$ are each isobutyl groups, m is 0, and n is 2, namely, di-isobutyl succinate.

In some embodiments, the compositions of the present invention comprise one or more dibasic esters selected from dimethyl glutarate, dimethyl adipate, dimethyl succinate, and combinations thereof.

Exemplary commercially available dibasic esters suitable for use in the present invention include, but are not limited to, dibasic esters commercially available from Invista (Wilmington, Del.).

When present, the one or more aliphatic dibasic esters are typically present in the compositions of the present invention in a total amount greater than 5 wt % to about 60 wt % (or any weight percent or weight percent range therebetween in multiples of 0.1 wt %, e.g., 5.1, 5.2 . . . 59.8, and 59.9 wt %) based on a total weight of a given composition. In some exemplary embodiments, a given composition comprises one or more dibasic esters in a total amount ranging from about 10 wt % to about 20 wt % based on a total weight of a given composition. In some exemplary embodiments, a given composition comprises one or more dibasic esters in a total amount ranging from about 15 wt % to about 30 wt % based on a total weight of a given composition.

When present as a combination of two or more dibasic esters, the two or more dibasic esters may be present in equal or varying amounts in the compositions of the present invention. Typically, when two or more dibasic esters are present, each of the two or more dibasic esters are independently typically present in an individual amount ranging from about 5 wt % to about 30 wt % based on a total weight of a given composition.

2. Alkyl Fatty Esters

The compositions of the present invention may comprise one or more alkyl fatty esters. Suitable alkyl fatty esters include, but are not limited to, alkyl fatty esters derived from C19-C23 dicarboxylated acids.

Exemplary commercially available alkyl fatty esters suitable for use in the present invention include, but are not limited to, alkyl fatty esters commercially available from Acme Hardesty, Blue Bell, Pa., such as methyl and ethyl oleates.

When present, the one or more alkyl fatty esters are typically present in the compositions of the present invention in a total amount of from about 5 wt % to about 60 wt % (or any weight percent or weight percent range therebetween in multiples of 0.1 wt %, e.g., 5.1, 5.2 . . . 59.8, and 59.9 wt %) based on a total weight of a given composition. In some exemplary embodiments, a given composition comprises one or more alkyl fatty esters in a total amount ranging from about 10 wt % to about 20 wt % based on a total weight of a given composition. In some exemplary embodiments, a given composition comprises one or more alkyl fatty esters in a total amount ranging from about 15 wt % to about 30 wt % based on a total weight of a given composition.

When present as a combination of two or more alkyl fatty esters, the two or more alkyl fatty esters may be present in equal or varying amounts in the compositions of the present invention. Typically, when two or more alkyl fatty esters are present, each of the two or more alkyl fatty esters are independently typically present in an individual amount ranging from about 5 wt % to about 30 wt % based on a total weight of a given composition.

3. Aromatic Alcohols

The compositions of the present invention may comprise one or more aromatic alcohols. Suitable aromatic alcohols include, but are not limited to, aromatic alcohols comprising phenyl ethanol, phenyl methanol, and 2-methyl phenol.

Exemplary commercially available aromatic alcohols suitable for use in the present invention include, but are not limited to, aromatic alcohols commercially available from Lanxess Corp. (Pittsburgh, Pa.) under various tradename designations, such as benzyl alcohol.

When present, the one or more aromatic alcohols are typically present in the compositions of the present invention in a total amount of from about 10 wt % to about 80 wt % (or any weight percent or weight percent range therebetween in multiples of 0.1 wt %, e.g., 10.1, 10.2 . . . 79.8, and 79.9 wt %) based on a total weight of a given composition. In some exemplary embodiments, a given composition comprises one or more aromatic alcohols in a total amount ranging from about 10 wt % to about 20 wt % based on a total weight of a given composition. In some exemplary embodiments, a given composition comprises one or more aromatic alcohols in a total amount ranging from about 50 wt % to about 60 wt % based on a total weight of a given composition.

4. Alkylbenzenesulfonic Acid Salts

The compositions of the present invention may comprise one or more alkylbenzenesulfonic acid salts. Typically, the alkyl group of the alkylbenzenesulfonic acid salt comprises a straight chain alkyl groups containing less than about 16 carbon atoms. In some exemplary embodiments, the alkyl group of the alkylbenzenesulfonic acid salt comprises a dodecyl group.

Typically, the alkylbenzenesulfonic acid salt comprises a sodium salt of a linear alkylbenzenesulfonic acid. Other suitable alkylbenzenesulfonic acid salts include, but are not limited to, isopropylamine alkylbenzenesulfonates such as isopropylamine alkylbenzenesulfonates comprising a branched alkyl group with up to about 12 carbon atoms.

Exemplary commercially available products containing one or more alkylbenzenesulfonic acid salts for use in the present invention include, but are not limited to, products commercially available from Pilot Chemical Company (Cincinnati, Ohio) under the trade designation CALSOFT®, such as CALSOFT® L40 and CALSOFT® L50.

When present, the one or more alkylbenzenesulfonic acid salts are typically present in the compositions of the present invention in a total amount greater than 0 wt % and up to about 10 wt % (or any weight percent or weight percent range therebetween in multiples of 0.1 wt %, e.g., 0.1, 0.2 . . . 9.8, and 9.9 wt %) based on a total weight of a given composition. In some exemplary embodiments, a given composition comprises one or more alkylbenzenesulfonic acid salts in a total amount ranging from about 0.1 wt % to about 5.0 wt % based on a total weight of a given composition. In some exemplary embodiments, a given composition comprises one or more alkylbenzenesulfonic acid salts in a total amount ranging from about 1.5 wt % to about 2.5 wt % based on a total weight of a given composition. In other exemplary embodiments, a given composition comprises one or more alkylbenzenesulfonic acid salts in a total amount ranging from about 1.0 wt % to about 2.0 wt % based on a total weight of a given composition.

Although many other surface active agents are known in addition to the above-described alkylbenzenesulfonic acid salts, alkylbenzenesulfonic acid salts have been found to provide a desired degree of product stability to the resulting compositions of the present invention. In some embodiments, other surface active agents may be used in combination with the above-described alkylbenzenesulfonic acid salts; however, typically, no other surface active agents are present other than the above-described alkylbenzenesulfonic acid salts. In some embodiments, other surface active agents are specifically excluded from the disclosed compositions. For example, in some embodiments, ethoxylated alcohols, nonyl phenol ethoxylates, and octyl phenol ethoxylates are specifically excluded from the disclosed compositions of the present invention.

5. Glycol Phenyl Ethers

In some embodiments, the compositions of the present invention may further comprise one or more glycol phenyl ethers. Suitable glycol phenyl ethers include, but are not limited to, propylene glycol phenyl ether and ethylene glycol phenyl ether, and combinations thereof.

Exemplary commercially available glycol phenyl ethers suitable for use in the present invention include, but are not limited to, glycol phenyl ethers commercially available from Dow Chemical (Midland, Mich.).

When present, the one or more glycol phenyl ethers are typically present in the compositions of the present invention in a total amount greater than 0 wt % and up to about 30 wt % (or any weight percent or weight percent range therebetween in multiples of 0.1 wt %, e.g., 0.1, 0.2 . . . 29.8, and 29.9 wt %) based on a total weight of a given composition. In some exemplary embodiments, a given composition comprises one or more glycol phenyl ethers in a total amount ranging from about 5 wt % to about 20 wt % based on a total weight of a given composition. In some exemplary embodiments, a given composition comprises one or more glycol phenyl ethers in a total amount ranging from about 5 wt % to about 20 wt % based on a total weight of a given composition.

6. Water

The compositions of the present invention may further comprise water for ready-to-use (i.e. not in concentrate form) compositions In some exemplary embodiments, a given composition comprises water in a total amount ranging from about 20 wt % to about 30 wt % based on a total weight of a given composition. In other exemplary embodiments (e.g., a "use-based" compositions, i.e., not a concentrate), a given composition comprises water in a total amount ranging from about 80 wt % to about 90 wt % based on a total weight of a given composition.

7. Other Additives

The compositions of the present invention may further comprise one or more optional additives. Suitable additives include, but are not limited to, a fragrance (e.g., a high molecular weight aromatic alcohol fragrance), dipropylene glycol, and defoamers or any combination thereof.

When present, each additive is typically present in the compositions (i.e., in a concentrate composition) of the present invention in a total amount greater than 0 wt % and up to about 5.0 wt % (or any weight percent or weight percent range therebetween in multiples of 0.1 wt %, e.g., 0.1, 0.2 . . . 4.8, and 4.9 wt %) based on a total weight of a given composition. In some exemplary embodiments, a given composition comprises one or more additives in a total amount ranging from about 1.0 wt % to about 5.0 wt % based on a total weight of a given composition. In some exemplary embodiments, a given composition comprises one or more additives in a total amount ranging from about 1.0 wt % to about 3.0 wt % based on a total weight of a given composition.

B. Composition Forms

The compositions of the present invention may be present as a liquid concentrate (e.g., as a colloidal concentrate composition or as an emulsion concentrate composition) or as a "use-based" composition (e.g., a diluted version of a concentrate composition). When in the form of a concentrate composition, the composition may comprise any of the above-described composition components at the weight percents as provided above.

To form a "use-based" composition, any of the above-described concentrate compositions may be diluted with water at a dilution ratio ranging from (i) about 1 to about 10 parts of the concentrate composition to (ii) about 10 to about 90 parts of water.

II. Methods of Making Compositions and Systems/Kits Containing the Same

The present invention is further directed to methods of making compositions. In one exemplary embodiment, the method of making a composition comprises mixing any of the disclosed composition components to form a given composition. Typically, the mixing step comprises high shear mixing of two or more of the herein described composition components.

The methods of making a composition of the present invention may comprise one or more additional method steps. Suitable additional method steps include, but are not limited to, forming a use composition from a concentrate composition by diluting the concentrate composition with water.

III. Applications/Uses

The present invention is further directed to methods of using the disclosed compositions to clean machine clothing, surfaces, and suction rolls. In one exemplary embodiment, the method of using a composition comprises applying a composition onto a substrate surface, wherein the composition comprises a blend of one or more alkyl fatty esters; one or more aromatic alcohols; and at least one alkylbenzene-sulfonic acid salt.

The methods of using compositions of the present invention may further comprise one or more additional method steps. Suitable additional method steps include, but are not limited to, cleaning a substrate surface off-line prior to applying a given composition of the present invention onto the substrate surface; and circulating the substrate through a vat containing one of the disclosed compositions of the present invention.

Exemplary uses include, but are not limited to, applying one or more of the above-described compositions onto a substrate, wherein the substrate comprises a paper machine clothing, a metallic material, a plastic or polymeric material (e.g., solid, film, foam, etc.), a ceramic material, a cellulosic material (e.g., wood, paper, wallpaper, fabric, etc.), a glass material, a silicone-containing material, a keratin-containing material (e.g., a finger nail), synthetic or natural rubber material, or any combination thereof.

Exemplary uses further include, but are not limited to, using one or more of the above-described compositions to remove a material from a substrate, wherein the material comprises fiber, fines and organic macro- and micro-"stickies".

In any of the above-described methods of using and/or providing one or more of the disclosed compositions, the methods of using and/or providing one or more of the disclosed compositions enables the use of environmentally-friendly compositions in place of conventional, environmentally-unfriendly compositions. For example, the disclosed compositions of the present invention typically do not include environmentally-unfriendly components including, but not limited to, acetone, methyl ethyl ketone, methylene chloride, isophorone, methyl acetate, ethyl acetate, n-methyl pyrrolidone, sodium hydroxide, potassium hydroxide, and terpenes or chemically modified versions thereof.

The present invention is further illustrated by the following examples, which are not to be construed in any way as imposing limitations upon the scope thereof. On the contrary, it is to be clearly understood that resort may be had to various other embodiments, modifications, and equivalents thereof which, after reading the description herein, may suggest themselves to those skilled in the art without departing from the spirit of the present invention and/or the scope of the appended claims.

EXAMPLES

Example 1

Preparation of Base Concentrate Compositions

Base compositions were prepared as follows using the following materials:

TABLE 1

Exemplary Base Concentrate Compositions

| Component | Tradename (if any) | Source |
|---|---|---|
| ethyl oleate | | Acme Hardesty (Blue Bell, PA) |
| Ethylene glycol phenyl ether | DOWANOL ™ EPh | Dow Chemical (Midland, MI) |
| Propylene glycol phenyl ether | DOWANOL ™ EPh | Dow Chemical (Midland, MI) |
| dipropylene glycol | | Dow Chemical (Midland, MI) |
| sodium salt of a C10 to C16 alkylbenzene sulfonic acid | CALSOFT ® L40 | Pilot Chemical (Cincinnati, OH) |
| mixture of aliphatic esters (i.e., mixture if dimethyl adipate, dimethyl glutarate, and dimethyl succinate) | FLEXISOLV ™ DBE ® Esters | Invista (Wilmington, DE) |
| defoamer | SUPPRESSOR ™ 1130 | Hydrite (Milwaukee, WI) |
| high molecular weight aromatic alcohol fragrance | | Atlanta Fragrance (Marietta, GA) |
| methyl oleate | | Acme Hardesty (Blue Bell, PA) |
| 2-phenyl ethanol | phenethyl alcohol | Lanxess (Pittsburgh, PA) |
| phenyl methanol | benzyl alcohol | Lanxess (Pittsburgh, PA) |
| 2-methyl phenol | o-cresol | Lanxess (Pittsburgh, PA) |

An emulsified or a colloidal dispersion of glycol phenyl ether and/or an aromatic alcohol in dibasic esters was introduced to a mixing vessel. A surface-active agent in the form of an isopropylamine branched alkyl benzene sulfonate or a sodium salt of a C10 to C16 alkylbenzene sulfonic acid was slowly added to the emulsified or colloidal dispersion of aromatic alcohol in dibasic esters under high shear conditions. The high shear conditions were generated using a high shear blender commercially available under the trade designation OSTER® from Sunbeam Products, a division of Jarden Corporation (Rye, N.Y.) with the mix setting on "MIX" for a minimum of 20 seconds.

TABLE 2

Exemplary Base Concentrate Compositions

| | Sample Concentrate Compositions | | | | | |
|---|---|---|---|---|---|---|
| Component | S1 | S2 | S3 | S4 | S5 | S6 |
| methyl oleate | 5 wt % | | 5 wt % | 5 wt % | 9 wt % | 15 wt % |
| ethyl oleate | | | | | | 5 wt % |
| phenyl ethanol | 10 wt % | | | | | |
| phenyl methanol | | 20 wt % | | 38 wt % | | 13 wt % |
| 2-methyl phenol | | | 10 wt % | | | |
| sodium salt of a C10 to C16 alkylbenzene sulfonic acid | 10 wt % | 10 wt % | 15 wt % | 6 wt % | 10 wt % | 15 wt % |
| mixture of aliphatic esters (i.e. dimethyl adipate, glutarate, succinate) | 50 wt % | 55 wt % | 40 wt % | 50 wt % | 60 wt % | 35 wt % |
| glycol phenyl ether | 23 wt % | 13 wt % | 29 wt % | | 20 wt % | 15 wt % |
| high molecular weight aromatic alcohol fragrance | 1.0 wt % | 1.0 wt % | | 1.0 wt % | | 1.0 wt % |
| dipropylene glycol | 1.0 wt % | 1.0 wt % | 1.0 wt % | | 1.0 wt % | 1.0 wt % |

Example 2

Preparation of Various Use-Based Compositions

Various use-based compositions were prepared as follows. The concentrate compositions shown in Example 1 above were introduced to a mixing vessel. Water was then slowly added to the mixture under high shear conditions to result in compositions as shown in Table 3 below.

TABLE 3

Exemplary Use-Based Compositions

| | Sample Compositions | | | | | |
|---|---|---|---|---|---|---|
| Component | D1 | D2 | D3 | D4 | D5 | D6 |
| water | 80 wt % | 85 wt % | 90 wt % | 95 wt % | 80 wt % | 85 wt % |
| concentrate | 20 wt % | 15 wt % | 10 wt % | 5 wt % | 20 wt % | 15 wt % |
| | S1 | S2 | S3 | S4 | S5 | S6 |

It should be understood that although the above-described chemical compositions and methods (of making and using the chemical compositions) are described as "comprising" one or more components, features or steps, the above-described chemical compositions and methods may "comprise," "consists of," or "consist essentially of" any of the above-described components and/or features and/or steps of the chemical compositions and methods. Consequently, where the present invention, or a portion thereof, has been described with an open-ended term such as "comprising," it should be readily understood that (unless otherwise stated) the description of the present invention, or the portion thereof, should also be interpreted to describe the present invention, or a portion thereof, using the terms "consisting essentially of" or "consisting of" or variations thereof as discussed below.

As used herein, the terms "comprises," "comprising," "includes," "including," "has," "having," "contains", "containing," "characterized by" or any other variation thereof, are intended to encompass a non-exclusive inclusion, subject to any limitation explicitly indicated otherwise, of the recited components. For example, a chemical composition and/or method that "comprises" a list of elements (e.g., components or features or steps) is not necessarily limited to only those elements (or components or features or steps), but may include other elements (or components or features or steps) not expressly listed or inherent to the chemical composition and/or method.

As used herein, the transitional phrases "consists of" and "consisting of" exclude any element, step, or component not specified. For example, "consists of" or "consisting of" used in a claim would limit the claim to the components, materials or steps specifically recited in the claim except for impurities ordinarily associated therewith (i.e., impurities within a given component). When the phrase "consists of" or "consisting of" appears in a clause of the body of a claim, rather than immediately following the preamble, the phrase "consists of" or "consisting of" limits only the elements (or components or steps) set forth in that clause; other elements (or components) are not excluded from the claim as a whole.

As used herein, the transitional phrases "consists essentially of" and "consisting essentially of" are used to define a chemical composition and/or method that includes materials, steps, features, components, or elements, in addition to those literally disclosed, provided that these additional materials, steps, features, components, or elements do not materially affect the basic and novel characteristic(s) of the claimed invention. The term "consisting essentially of" occupies a middle ground between "comprising" and "consisting of".

From the above disclosure of the general principles of the present invention and the preceding detailed description, those skilled in this art will readily comprehend the various modifications, re-arrangements and substitutions to which the present invention is susceptible. Therefore, the scope of the invention should be limited only by the following claims and equivalents thereof. In addition, it is understood to be within the scope of the present invention that the disclosed and claimed chemical compositions may be useful in other applications (i.e., other than papermaking processes). Therefore, the scope of the invention may be broadened to include the use of the claimed and disclosed structures for such other applications.

What is claimed is:

1. A concentrate composition comprising a blend of:
one or more aliphatic dibasic esters;
one or more aromatic alcohols;
at least one alkylbenzenesulfonic acid salt; and
one or more alkyl fatty esters, said one or more alkyl fatty esters comprising from about 2.0 wt % to about 30 wt % of said concentrate composition based on a total weight of said concentrate composition.

2. The concentrate composition of claim 1, wherein said one or more aliphatic dibasic esters comprise from about 20 wt % to about 80 wt % of said concentrate composition, said one or more aromatic alcohols comprise from about 5.0 wt % to about 50 wt % of said concentrate composition, and said at least one alkylbenzenesulfonic acid salt comprises from about 2.0 wt % to about 20 wt % of said concentrate composition, all weight percentages being based on a total weight of said concentrate composition.

3. The concentrate composition of claim 2, wherein said one or more aliphatic dibasic esters comprise from about 35 wt % to about 60 wt % of said concentrate composition, said one or more aromatic alcohols comprise from about 10 wt % to about 40 wt % of said concentrate composition, and said at least one alkylbenzenesulfonic acid salt comprises from about 5.0 wt % to about 15 wt % of said concentrate composition, all weight percentages being based on a total weight of said concentrate composition.

4. The concentrate composition of claim 3, wherein said concentrate composition further comprises a fragrance, said fragrance comprising from greater than 0 wt % to about 2.0 wt % of said concentrate composition based on a total weight of said concentrate composition.

5. The concentrate composition of claim 1, wherein said concentrate composition possesses a vapor pressure of <0.1 mm of Hg at 20° C. and meets low vapor pressure, volatile organic compound (LVP-VOC) exemption criteria for industrial cleaning products.

6. The concentrate composition of claim 1, wherein said concentrate composition has pH of from about 6 to about 7.

7. The concentrate composition of claim 1, wherein said concentrate composition has a flash point greater than 200° F. and possesses a non-flammable rating.

8. A diluted use composition comprising (i) the concentrate composition of claim 1, and (ii) a diluting amount of water.

9. The diluted use composition of claim 8, wherein said concentrate composition is present in a total amount of from about 5 wt % to about 20 wt %, and said diluting amount of water is present in a total amount of from about 80 wt % to about 95 wt %, all weight percents being based on a total weight of said diluted use composition.

10. A substrate coated, flooded, immersed or impregnated with the diluted use composition of claim 8.

11. The substrate of claim 10, wherein the substrate comprises paper machine clothing, surfaces, and/or suction rolls.

12. The substrate of claim 11, wherein the paper machine clothing comprises a forming wire, said forming wire comprising a woven plastic fabric mesh conveyor belt.

13. The substrate of claim 11, wherein the paper machine clothing comprises a dewatering/press fabric, said dewatering/press fabric comprising a nonwoven or woven plastic fabric belt.

14. The substrate of claim 11, wherein the paper machine clothing comprises a dryer fabric, said dryer fabric comprising a nonwoven or woven plastic fabric belt.

15. A method of cleaning a substrate, said method comprising:
applying the diluted use composition of claim 8 onto a substrate.

16. A concentrate composition comprising a blend of:
one or more aliphatic dibasic esters;
one or more aromatic alcohols; and
one or more alkyl fatty esters, said one or more alkyl fatty esters comprising from about 2.0 wt % to about 30 wt % of said concentrate composition based on a total weight of said concentrate composition.

17. The concentrate composition of claim 16, wherein said concentrate composition comprises two or more aliphatic dibasic esters, and each aliphatic dibasic ester has a structure:

$$R_3—O—(CO)—(CR_1R_2)_m(CH_2)_n—(CO)—O—R_4$$

wherein:
$R_1$ and $R_2$ are each independently (i) hydrogen or (ii) a straight chain or branched alkyl groups, and at least one of $R_1$ and $R_2$ comprises a straight chain or branched alkyl groups;
$R_3$ and $R_4$ are each independently straight chain or branched alkyl groups;
m is 0 or 1; and
n is an integer greater than 1.

18. The concentrate composition of claim 17, wherein at least one aliphatic dibasic ester of said two or more aliphatic dibasic esters has a structure wherein m is 0; n is 2; and $R_3$ and $R_4$ are each independently straight chain or branched alkyl groups comprising up to 8 carbon atoms.

19. The concentrate composition of claim 18, wherein at least one aliphatic dibasic ester of said two or more aliphatic dibasic esters has a structure wherein m is 0; n is 4; and $R_3$ and $R_4$ are each independently straight chain or branched alkyl groups comprising up to 8 carbon atoms.

20. The concentrate composition of claim 18, wherein at least one aliphatic dibasic ester of said two or more aliphatic dibasic esters has a structure wherein m is 0; n is 3; and $R_3$ and $R_4$ are each independently straight chain or branched alkyl groups comprising up to 8 carbon atoms.

21. The concentrate composition of claim 17, wherein said concentrate composition further comprises a fragrance and a defoamer, said fragrance and said defoamer each independently comprise from greater than 0 wt % to about 2.0 wt % of said concentrate composition based on a total weight of said concentrate composition.

22. A concentrate composition comprising a blend of:
one or more aliphatic dibasic esters;
one or more aromatic alcohols; and
one or more alkyl fatty esters, said one or more alkyl fatty esters comprising from about 2.0 wt % to about 30 wt % of said concentrate composition based on a total weight of said concentrate composition,
wherein said concentrate composition possesses a vapor pressure of <0.1 mm of Hg at 20° C. and meets low vapor pressure, volatile organic compound (LVP-VOC) exemption criteria for industrial cleaning products.

* * * * *